US008121328B2

(12) United States Patent
Kral et al.

(10) Patent No.: US 8,121,328 B2
(45) Date of Patent: Feb. 21, 2012

(54) HEARING DEVICE WITH A CONNECTING PIECE FASTENED TO THE HOUSING FRAME

(75) Inventors: Holger Kral, Fürth (DE); Michael Sattler, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 933 days.

(21) Appl. No.: 12/156,593

(22) Filed: Jun. 2, 2008

(65) Prior Publication Data

US 2008/0298619 A1 Dec. 4, 2008

(30) Foreign Application Priority Data

Jun. 4, 2007 (DE) ..... 10 2007 025 936

(51) Int. Cl.
*H04R 25/00* (2006.01)

(52) U.S. Cl. ..... 381/330; 381/324

(58) Field of Classification Search ..... 381/322, 381/324, 327, 328, 330, 381; 181/129–130
See application file for complete search history.

(56) References Cited

U.S. PATENT DOCUMENTS

| | | | |
|---|---|---|---|
| 7,221,770 | B2 | 5/2007 | Fickweiler et al. |
| 2005/0020127 | A1 | 1/2005 | Fickweiler et al. |
| 2008/0002848 | A1 | 1/2008 | Heerlein et al. |

FOREIGN PATENT DOCUMENTS

| | | | |
|---|---|---|---|
| DE | 3921551 | A1 | 1/1991 |
| DE | 4230308 | C1 | 5/1993 |
| DE | 43 27 634 | C1 | 6/1994 |
| DE | 103 33 293 | A1 | 3/2005 |
| DE | 10 2006 029 819 | A1 | 1/2008 |

*Primary Examiner* — Tuan Nguyen

(57) ABSTRACT

A hearing device which is simple to assemble and to which a wearing hook can be fastened in a stable fashion is provided. The hearing device includes a receiver, which has a sound outlet, a wearing hook, which has a sound channel, a connecting piece for connecting the sound outlet of the receiver to the sound channel of the wearing hook and includes a housing frame, in which the receiver and to which the wearing hook are fastened respectively. The connecting piece may be formed largely of metal or ceramic and may be directly fastened to the housing frame.

16 Claims, 4 Drawing Sheets

HEARING DEVICE WITH A CONNECTING PIECE FASTENED TO THE HOUSING FRAME

CROSS REFERENCE TO RELATED APPLICATIONS

This application claims priority of German Patent Office application No. 10 2007 025 936.2 DE filed Jun. 4, 2007, which is incorporated by reference herein in its entirety.

FIELD OF INVENTION

The present invention relates to a hearing device to be worn behind the ear, comprising a receiver, which has a sound outlet, a wearing hook, which has a sound channel, a connecting piece for connecting the sound outlet of the receiver to the sound channel of the wearing hook and comprising a housing frame, in which and onto which the receiver and the wearing hook are fastened respectively.

BACKGROUND OF INVENTION

Hearing devices are portable hearing apparatuses which are used to supply the hard-of-hearing. To accommodate the numerous individual requirements, different configurations of hearing devices such as behind-the-ear hearing devices (BTE), in-the-ear hearing devices (ITE), e.g. also concha hearing devices or completely-in-the-channel devices (CIC), are provided. The hearing devices listed by way of example are worn on the outer ear or in the auditory canal. Furthermore, bone conduction hearing aids, implantable or vibrotactile hearing aids are also available on the market. The damaged hearing is herewith either stimulated mechanically or electrically.

Essential components of the hearing devices include in principle an input converter, an amplifier and an output converter. The input converter is generally a receiving transducer, e.g. a microphone and/or an electromagnetic receiver, e.g. an induction coil. The output converter is mostly realized as an electroacoustic converter, e.g. a miniature loudspeaker, or as an electromechanical converter, e.g. a bone conduction receiver. The amplifier is usually integrated into a signal processing unit. This main configuration is shown in the example in FIG. 1 of a behind-the-ear hearing device. One or a number of microphones 2 for recording the ambient sound are incorporated in a hearing device housing 1 to be worn behind the ear. A signal processing unit 3, which is similarly integrated into the hearing device housing 1, processes the microphone signals and amplifies them. The output signal of the signal processing unit 3 is transmitted to a loudspeaker and/or receiver 4, which outputs an acoustic signal. The sound is optionally transmitted to the ear drum of the device wearer via a wearing hook 6 and a sound tube, which is fixed with an otoplastic in the auditory canal. The power supply of the hearing device and in particular of the signal processing unit 3 is supplied by a battery 5 which is likewise integrated into the hearing device housing 1.

With special types of BTE hearing devices, the housing consists of a frame and a housing casing fastened thereto. Here the frame receives all the forces which are applied to the hearing device from the outside and provides the hearing device components with the necessary stabilization.

SUMMARY OF INVENTION

A wearing hook 6 tailored to the hearing device wearer is generally fastened on the hearing device housing and/or hearing device frame on a BTE hearing device. The inside of the wearing hook 6 has a sound channel 7, by way of which the sound is guided from the hearing device receiver to the auditory canal. A connecting piece is thus needed on the interface between the hearing device housing and/or hearing device frame and the wearing hook, with which connecting piece a sound guiding piece in the hearing device housing can be connected to the sound channel in the wearing hook. In the case of hearing devices with frames, this connecting piece is usually integrated into the frame. This means that the connecting piece consists of the same plastic as the frame, since frames are generally made of a plastic injection molded part. The disadvantage of such frame constructions with an integrated connecting piece is that a connecting piece of this type is not stable and is subjected to considerable wear. It must namely receive not only withdrawal and torsional forces, but also be able to withstand the repeated removal of the hearing device housing from the wearing hook for component cleaning or maintenance purposes for instance.

The frame construction is advantageous in that the hearing device can be manufactured in a simpler and faster manner, since the inside of the frame is left open until the covering shells are attached to the frame at the end of the manufacturing process in order to position and fix the hearing device components from several sides.

The publication DE 103 33 293 A1 discloses a connecting piece for hearing device wearing hooks, which also allows for a slim hearing device design in the transition region between the wearing hook and the device housing. The one-piece, metallic connecting piece which has a sound canal running therethrough has a fastening piece, a stop and a connecting lug, so that forces acting on the connecting piece can be introduced into the housing of the hearing device across several regions of the connecting piece. The publication DE 43 27 634 C1 also discloses a hearing aid device which is to be worn behind the hear having a wearing part fastening which is improved in terms of manufacturing technology and in terms of acoustics. A connection coupled to a sound transducer and fastened in the housing is detachably connected to the wearing part in a rotationally secure manner by way of a locking and sealing connection.

The subsequently published publication DE 10 2006 029 819 A1 also describes a hearing device with a fastening for a receiver tube. The connecting piece is connected to a receiver facility by way of the receiver tube, in order to guide an acoustic signal generated by the receiver facility to an acoustic output of the hearing device. The receiver tube and the connecting piece are embodied as a plug-in connection and are essentially connected to one another in an acoustically sealed fashion. The receiver tube and the connecting piece have at least one projection, which is embodied such that it holds the receiver tube against the connecting piece. A connecting segment can be embodied as a separate insert or alternatively in one piece with the housing.

The object of the present invention thus consists in providing a BTE hearing device, with which the wearing hook is fastened in a stable fashion and can be detached repeatedly without considerable wear.

This object is achieved in accordance with the invention by a hearing device to be worn behind the ear, comprising a receiver, which has a sound outlet, a wearing hook, which has a sound channel, a connecting piece for connecting the sound outlet of the receiver to the sound channel of the wearing hook and comprising a housing frame, in which and onto which the receiver and the wearing hook are fastened respectively, with the connecting piece largely consisting of metal or ceramic and being directly fastened to the housing frame.

The connecting piece, which largely consists of metal or ceramic, advantageously allows a stable, detachable connection of the wearing hook of a hearing device to the frame construction thereof. The withdrawal and torsional forces are thus transferred from the wearing hook into the frame. In addition, the connecting piece connects and seals the sound channels of the wearing hook and hearing device with one another.

In a special embodiment, the housing frame is embodied in two halves. As a result, the fastening of hearing device components during the manufacture is further simplified. The two halves of the housing frame are then preferably held together by means of the connecting piece. Aside from the functions "stabilizing the wearing hook" and "transmitting the sound", the connecting piece achieves the third function of "holding together the housing halves". There is thus no need for special assembly parts, which are exclusively used for fastening the housing halves to one another.

With a further advantageous embodiment, provision is made for the housing frame to be pinned to the connecting piece. This pinning process is particularly favorable precisely in respect of the assembly time.

With one development, a recess can be formed through the two halves of the housing frame, into which recess the connecting piece is fitted in a form-fit and rotationally secure fashion, with each halve being pinned to the connecting piece in each instance with one single pin at right angles to the fitting direction. The rotational security of the connecting piece and/or of the wearing hook in respect of the frame is improved here.

According to another development, a pipe connection of the connecting piece, which protrudes into the housing frame, can be flexible. This allows better allowances to be made for the space requirement in the housing frame.

Furthermore, it may also be advantageous for the connecting piece to be injected into one part of the housing frame. This measures again allows the assembly times to be reduced, but also increases the stability.

BRIEF DESCRIPTION OF THE DRAWINGS

The present invention is described in more detail with reference to the appended drawings, in which.

DETAILED DESCRIPTION OF INVENTION

The exemplary embodiments illustrated in more detail below represent preferred embodiments of the present invention.

Figure 1:
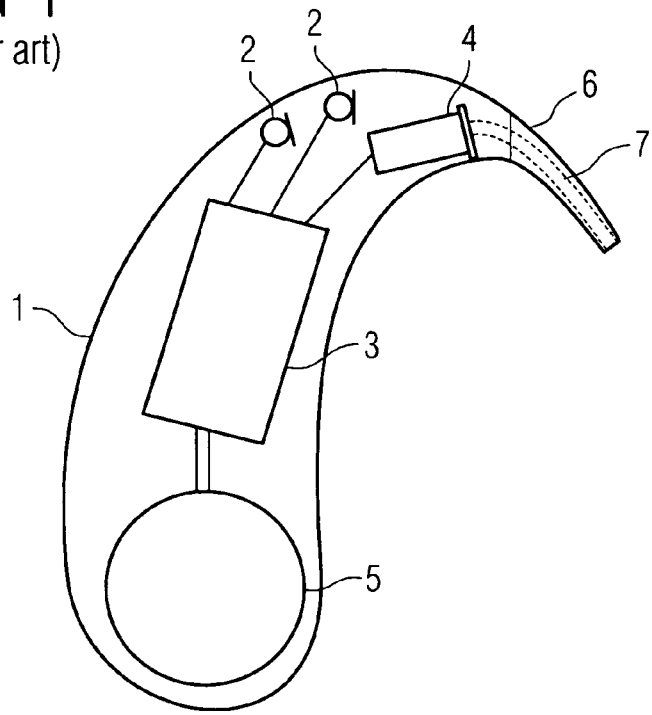
FIG 1 (Prior art)
FIG. 1 shows a basic diagram with the essential components of a hearing device.
Figure 2:
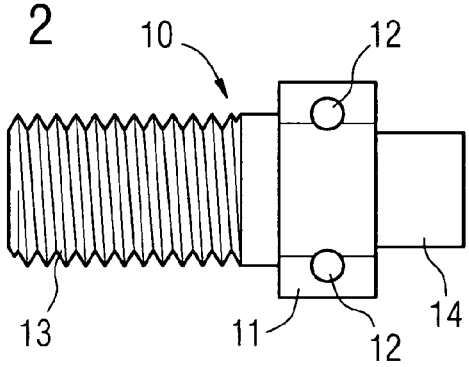
FIG. 2 shows a longitudinal side view of an inventive connecting piece.

A first variant of an inventive connecting piece is shown in FIGS. 2 to 5. FIG. 2 shows a longitudinal side view of this connecting piece 10. It is essentially tubular and has a flange 11, which is provided on its part with fastening boreholes 12. These fastening boreholes 12 run in parallel to one another and at right angles to the longitudinal axis of the connecting piece. The flange 11 separates a threaded part 13 from a pipe connection 14. The wearing hook of the hearing device is screwed onto the threaded part 13. The pipe connection 14 is used however to connect a receiver directly or a sound tube, which leads to the receiver of the hearing device. The flange 11 fastens the connecting piece 10 to a device frame of the hearing device (compare FIGS. 10 to 13).

Figure 3:
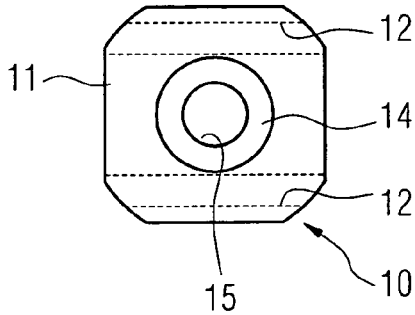
FIG. 3 shows a front side view of the connecting piece in FIG. 2.

FIG. 3 shows a view of the connecting piece 10 from the side of the receiver support 14. It is apparent that the flange 11 is essentially embodied as a square with rounded corners. This form ensures rotational security, if the connecting piece 10 is integrated into the device frame. FIG. 3 also shows the sound channel 15 through the connecting piece 10.

Figure 4:
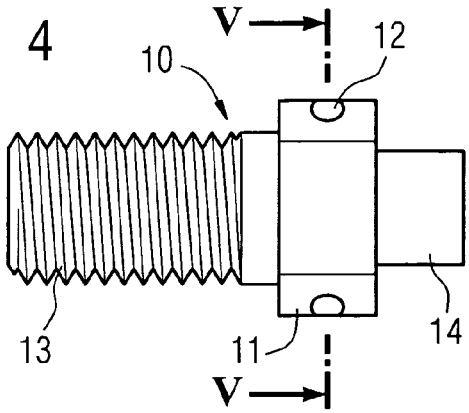
FIG. 4 shows a longitudinal side view of the connecting piece in FIG. 2 rotated axially by 90°.
Figure 5:
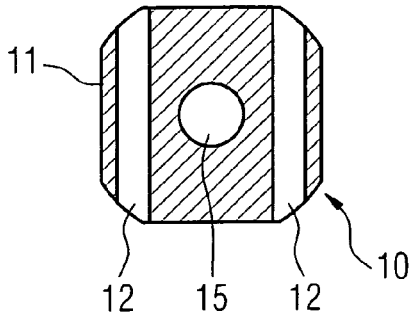
FIG. 5 shows a section through the connecting piece in FIG. 4.

FIG. 4 shows a top view of the connecting piece 10 in FIG. 2. FIG. 4 illustrates a sectional line V-V. The corresponding section is reproduced in FIG. 5. It shows the contour of the flange 11 as well as the two fastening boreholes 12 which run in parallel to one another. Furthermore, the sound channel 15 which runs at right angles to the two fastening boreholes 12 can also be seen.

Figure 6:
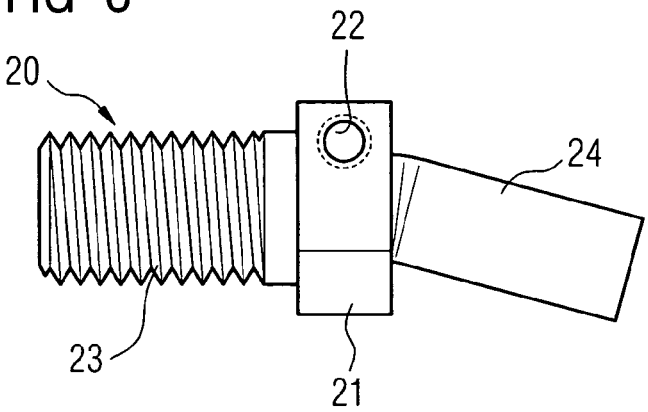
FIG. 6 shows a longitudinal side view of the connecting piece according to a further embodiment of the present invention.
Figure 7:
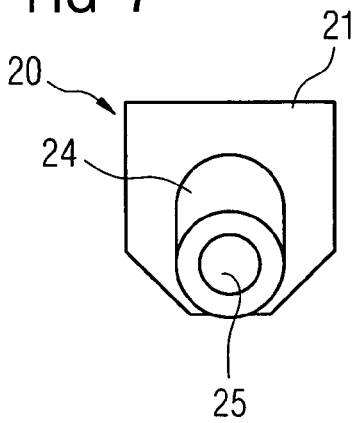
FIG. 7 shows the front side view of the connecting piece in FIG. 6.

A further variant of a connecting piece is shown in FIGS. 6 to 9. FIG. 6 shows this connecting piece 20 in the longitudinal side view. Like the preceding variants, a flange 21 with a fastening borehole 22 also separates a threaded part 23 from a pipe connection 24 here. The flange 21 is in turn approximately square-shaped, with two corners of the square being beveled. This can be seen in FIG. 7. The fastening borehole 22 passes through those corners, which are not beveled.

FIG. 6 also shows the pipe connection 24, the axis of which is somewhat inclined in respect of the axis of the threaded part 23. This pipe connection 24 can if necessary be individually bent. As a result, the connecting piece 20 can be better adjusted to the constructive conditions within the hearing device. The inclination of the pipe connection 24, which has the sound channel 25, can also be seen in FIG. 7.

Figure 8:
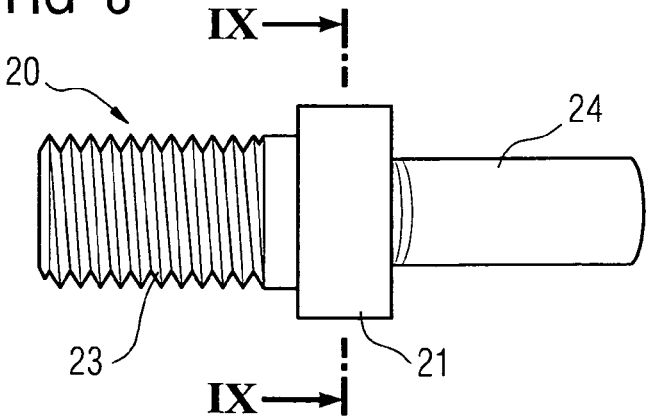
FIG. 8 shows a top view of the connecting piece in FIG. 6.
Figure 9:
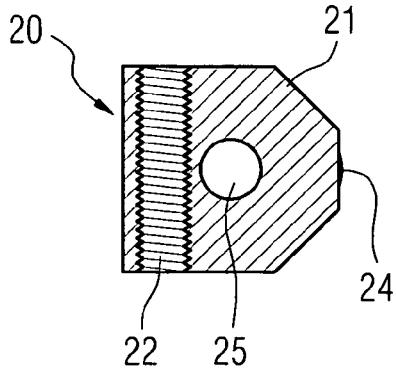
FIG. 9 shows a sectional view of the connecting piece in FIG. 8.

FIG. 8 shows a top view of the connecting piece in FIG. 6. The Figure shows a section IX-IX through the flange 21. FIG. 9 shows the associated sectional view. This also shows the fastening borehole 22, which passes through the non-beveled segment of the flange 21 and is also at right angles to the sound channel 25.

Figure 10:
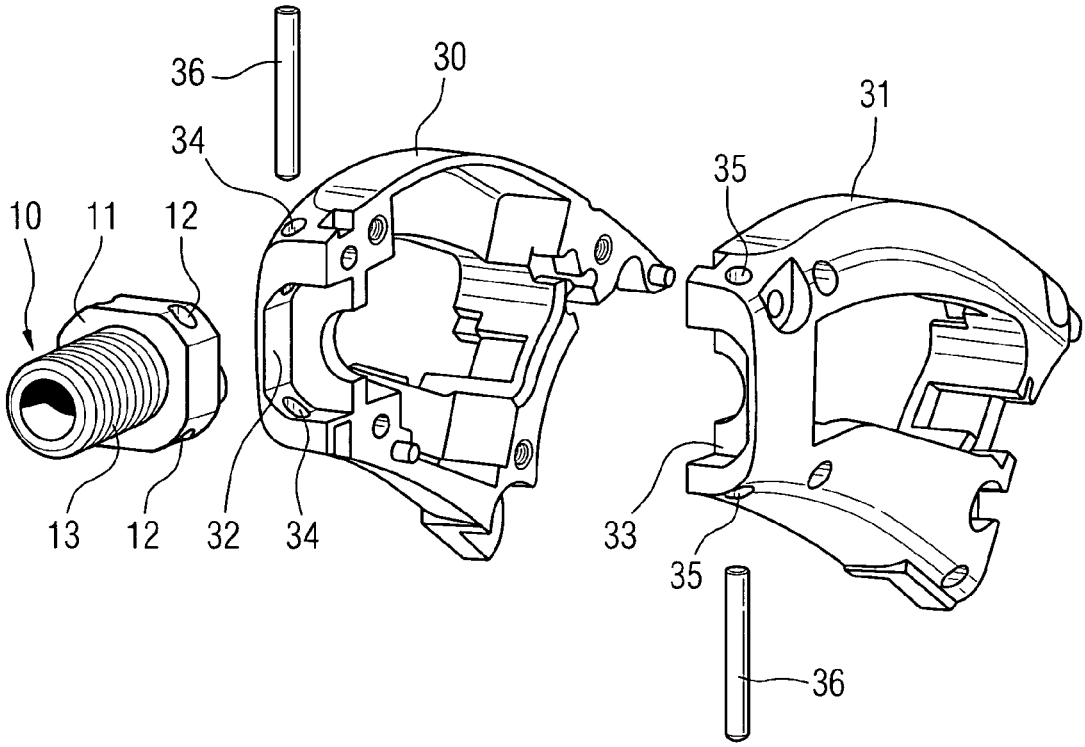
FIG. 10 shows an exploded view of a hearing device frame having a connecting piece.

FIG. 10 now shows how the connecting piece 10 in FIGS. 2 to 5 can be assembled in a housing frame. The housing frame consists here of two housing halves 30, 31. They each have a recess 32, 33. These two recesses 32 and 33 have an inner contour when the two housing halves 30 and 31 are assembled, said inner contour corresponding to the outer contour of the flange 11 of the connecting piece 10.

The two housing halves 30 and 31 also each have a borehole 34, 35. A pin 36 is inserted into each of these boreholes 34, 35 in order to assemble the connecting piece. The pins 36 also penetrate the fastening boreholes 12 of the connecting piece 10 during assembly.

Figure 11:
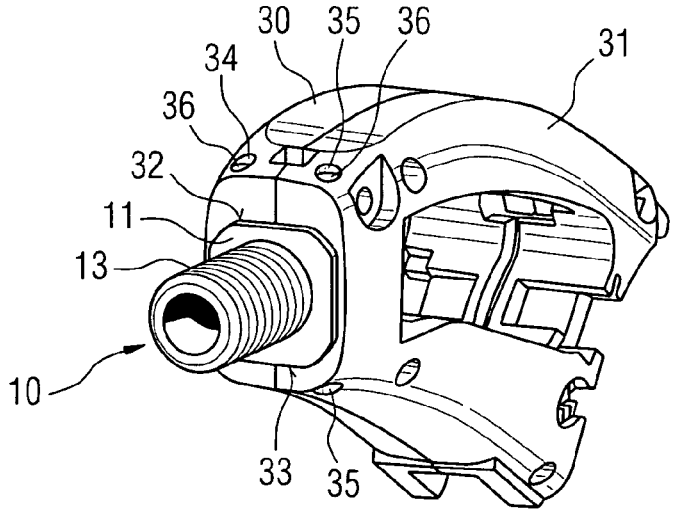
FIG. 11 shows the hearing device frame with a connecting piece in FIG. 10 when assembled.

FIG. 11 shows the hearing device housing and/or a part thereof (the housing halves 30 and 31 are not shown completely as in FIG. 10) in an assembled state. It is apparent how the flange 11 of the connecting piece 10 is fitted into the corresponding recess 32, 33 of the frame halves 30, 31 in a form-fit and rotationally secure fashion. As the pins 36 are not only inserted through the boreholes 34, 35 of the housing halves 30, 31, but instead also through the fastening boreholes 12 of the connecting piece 10, the housing halves 30, 31 are held together by the connecting piece 10.

Figure 12:
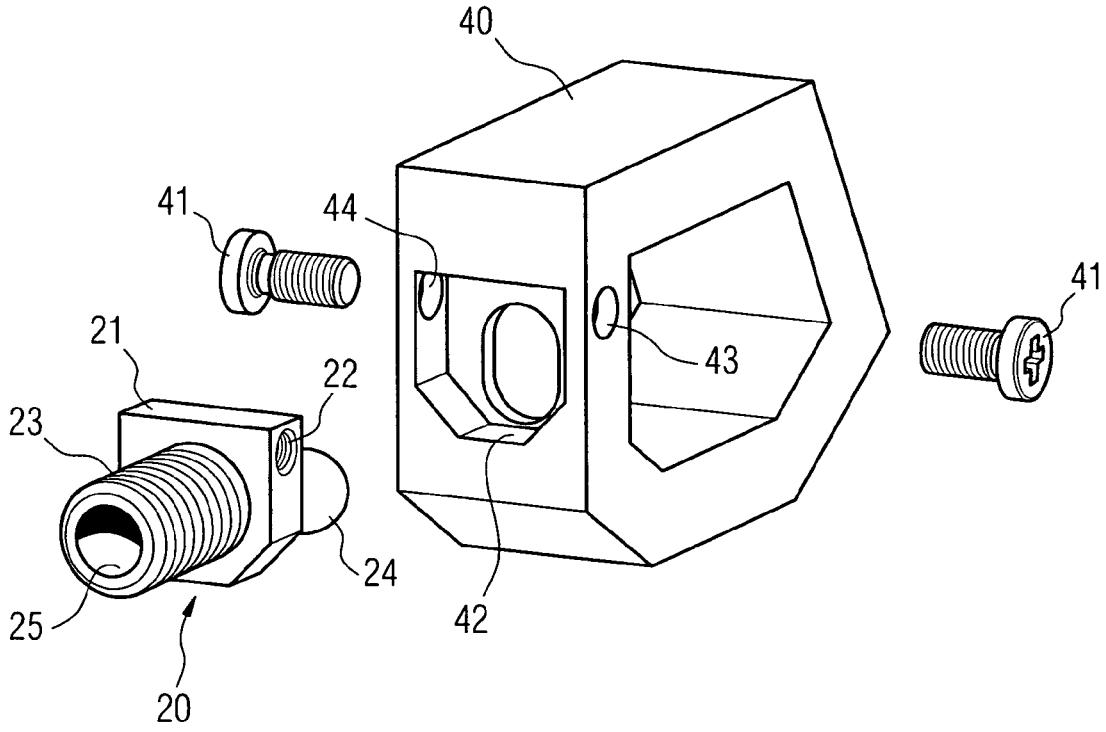
FIG. 12 shows an exploded view of another hearing device frame with the connecting piece in FIG. 6
Figure 13:
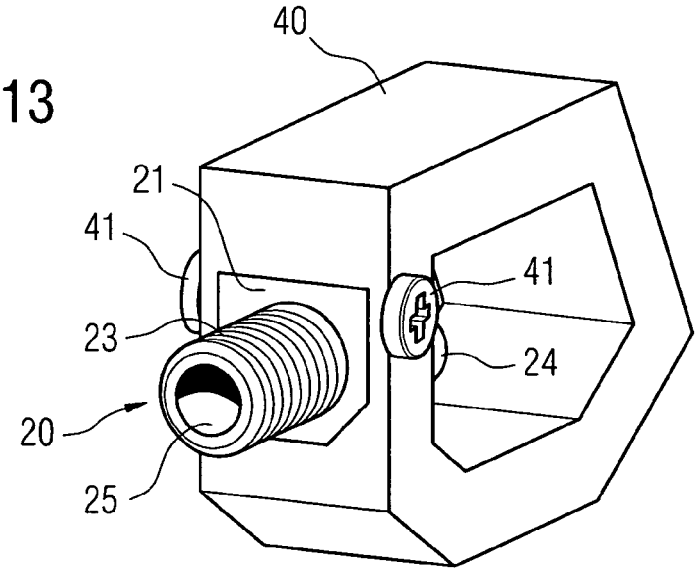
FIG. 13 shows the hearing device frame with the connecting piece in FIG. 12 when assembled.

FIGS. 12 and 13 show a further embodiment of the present invention. In accordance with FIG. 12, the connecting piece 20 in FIGS. 6 to 9 is screwed into a one-piece housing frame 40, which is again not shown completely here, with the aid of two screws 41. A recess 42 in the housing frame 40 has an inner contour, which corresponds to the outer contour of the flange 21 of the connecting piece 20. Furthermore, boreholes 43 and 44 are also provided in the side walls of the frame 40, through which boreholes the screws 41 are guided.

FIG. 13 shows the housing frame 40 and the connecting piece 20 when assembled. The two screws 41 are screwed into the fastening borehole 22 (shown here with an inner thread) through the boreholes 43, 44, because the connecting piece 20 was fitted into the recess 43 in the direction of the sound channel 25. The special contour of the recess 42 and/or the flange 21 provide for the connecting piece 20 to be automatically introduced into the correct position prior to screwing during assembly. Furthermore, these contours offer a rotational safeguard if the wearing hook of the hearing device is screwed onto the threaded part 23 or is screwed off therefrom. The screws 41 likewise offer a rotational safeguard. They primarily ensure however that the connecting piece 20 is fixed in the axial direction, i.e. in the fitting direction.

The two exemplary embodiments thus provide for a frame construction for a hearing device with removable covering shells, thereby enabling faster manufacture of the hearing device. They also offer the possibility of inserting a very stable connecting piece 10, 20 made of metal or ceramic for instance. This connecting piece 10, 20 can if necessary also be injected into the frame 40 and/or a frame half 30, 31.

The invention claimed is:

1. A hearing device to be worn behind the ear, comprising:
a receiver having a sound outlet;
a wearing hook having a sound channel;
a housing frame in which the receiver and to which the wearing hook are fastened respectively; and
a connecting piece that connects the sound outlet of the receiver to the sound channel of the wearing hook, the connecting piece received within a recess on an external surface of the housing frame and held within the recess by a connecting pin passing through the housing frame and the connecting piece to pin the connecting piece to the housing frame.

2. The hearing device as claimed in claim 1, wherein the connecting piece largely formed from metal or ceramic.

3. The hearing device as claimed in claim 1, wherein the housing frame has two halves.

4. The hearing device as claimed in claim 3, wherein the two halves of the housing frame are held together by the connecting piece and the connecting pin.

5. The hearing device as claimed in claim 4, wherein the recess is formed within the two halves of the housing frame in order to fit the connecting piece in a form-fit fashion into the recess and with each half being pinned to the connecting piece with the connecting pin in each instance at right angles to the fitting direction.

6. The hearing device as claimed in claim 1, wherein the connecting piece comprises a pipe connection which protrudes into the housing frame and is flexible.

7. The hearing device as claimed in claim 1, wherein the connecting piece is injected into a part of the housing frame.

8. A hearing device to be worn behind the ear, comprising:
a receiver having a sound outlet;
a wearing hook having a sound channel;
a housing frame formed by a plurality of pieces and in which the receiver and to which the wearing hook are fastened respectively;
a connecting piece that connects the sound outlet of the receiver to the sound channel of the wearing hook, the connecting piece received within a recess on an external surface of the housing frame and held within the recess by a connecting pin passing through the plurality of pieces of the housing frame and the connecting piece to pin the connecting piece to each one of the plurality of pieces of the housing frame;
wherein the recess is formed within the plurality of pieces of the housing frame in order to fit the connecting piece in a form-fit fashion into the recess and with each one of the plurality of pieces of the housing frame being pinned to the connecting piece such that pieces of the housing frame are held together by the connecting piece.

9. The hearing device as claimed in claim 8, wherein the connecting piece is largely formed from metal or ceramic.

10. The hearing device as claimed in claim 8, wherein the connecting piece comprises a pipe connection which protrudes into the housing frame and is flexible.

11. The hearing device as claimed in claim 8, wherein the connecting piece is injected into a part of the housing frame.

12. A hearing device to be worn behind the ear, comprising:
a receiver having a sound outlet;
a wearing hook having a sound channel;
a housing frame formed by a plurality of pieces and in which the receiver and to which the wearing hook are fastened respectively;
a connecting piece that connects the sound outlet of the receiver to the sound channel of the wearing hook, the connecting piece received within a recess on an external surface of the housing frame and held within the recess b a connecting pin passing throuth the housing frame and the connecting piece to pin the housing frame to the connecting piece; and
wherein the connecting piece comprises a pipe connection which protrudes into the housing frame and is flexible.

13. The hearing device as claimed in claim 12, wherein the recess is formed within the plurality of pieces of the housing frame in order to fit the connecting piece in a form-fit fashion into the recess and with each piece being pinned to the connecting piece such that pieces of the housing frame are held together by the connecting piece.

14. The hearing device as claimed in claim 12, wherein the connecting piece is largely formed from metal or ceramic.

15. The hearing device as claimed in claim 12, wherein the connecting piece comprises a pipe connection which protrudes into the housing frame and is flexible.

16. The hearing device as claimed in claim 12, wherein the connecting piece is injected into a part of the housing frame.

* * * * *

UNITED STATES PATENT AND TRADEMARK OFFICE

CERTIFICATE OF CORRECTION

PATENT NO. : 8,121,328 B2
APPLICATION NO. : 12/156593
DATED : February 21, 2012
INVENTOR(S) : Holger Kral and Michael Sattler It is certified that error appears in the above-identified patent and that said Letters Patent is hereby corrected as shown below:

Column 6, line 46 (Claim 12 line 11) "b. a connecting pin passing throuth" should be replaced with --by a connecting pin passing through--

Signed and Sealed this
Fifth Day of February, 2013

Teresa Stanek Rea
*Acting Director of the United States Patent and Trademark Office*